US008925174B2

(12) United States Patent
Ciliberti et al.

(10) Patent No.: US 8,925,174 B2
(45) Date of Patent: Jan. 6, 2015

(54) METHOD AND APPARATUS FOR INSTALLING A RACQUET SAFETY CORD

(76) Inventors: A. Cil Ciliberti, Yonkers, NY (US); Ruben Gonzalez, Staten Island, NY (US)

( * ) Notice: Subject to any disclaimer, the term of this patent is extended or adjusted under 35 U.S.C. 154(b) by 33 days.

(21) Appl. No.: 13/269,214

(22) Filed: Oct. 7, 2011

(65) Prior Publication Data

US 2012/0159762 A1 Jun. 28, 2012

Related U.S. Application Data

(60) Provisional application No. 61/427,422, filed on Dec. 27, 2010.

(51) Int. Cl.
*B25B 33/00* (2006.01)

(52) U.S. Cl.
CPC ..... *B25B 33/00* (2013.01)
USPC ..... 29/433; 29/241; 473/549; 473/553

(58) Field of Classification Search
CPC ..... B25B 33/00
USPC ..... 29/433, 428, 241, 270, 464; 473/524, 473/549, 553; 242/587; 223/50, 99; 112/49; 254/134.3 FT
See application file for complete search history.

(56) References Cited

U.S. PATENT DOCUMENTS

| | | | | | |
|---|---|---|---|---|---|
| 424,518 | A | * | 4/1890 | Van Norman | 223/99 |
| 4,247,975 | A | * | 2/1981 | Robinson | 473/551 |
| 5,458,317 | A | * | 10/1995 | Caracofe et al. | 254/134.3 R |
| 5,797,814 | A | * | 8/1998 | Janes et al. | 473/551 |

* cited by examiner

*Primary Examiner* — Alexander P Taousakis
*Assistant Examiner* — Steven A Maynard
(74) *Attorney, Agent, or Firm* — Faegre Baker Daniels LLP

(57) ABSTRACT

A method and apparatus for quickly and easily installing a safety cord in the butt of a racquet, without damaging the safety cord, includes a handle and an elongate structure having a loop for engaging the safety cord.

11 Claims, 6 Drawing Sheets

METHOD AND APPARATUS FOR INSTALLING A RACQUET SAFETY CORD

CROSS-REFERENCE TO RELATED APPLICATIONS

This application claims the benefit under 35 U.S.C. §119 (e) to U.S. Provisional Application No. 61/427,422, filed on Dec. 27, 2010, entitled "Method and Apparatus for Installing a Racquet Safety Cord," which is incorporated herein by reference in its entirety.

TECHNICAL FIELD

The present invention relates generally to sporting equipment and more particularly to racquet sports.

BACKGROUND

A variety of games are played with racquets, including tennis, racquetball, and squash. In some cases, particularly in racquetball, the racquet includes a safety cord, tether, or lacer (also known as a wrist cord, tether, or lacer) that secures the racquet to the user's wrist in order to prevent possible injury that could be caused by the users losing their grip on the racquet. Moreover, the rules of racquetball typically require use of a safety cord.

Individuals who play racquetball occasionally have a need to replace the safety cord on the racquet, as it may come out of the handle, wear out or be replaced for personal preference. Replacing the safety cord entails attempting to thread a safety cord, which is frequently a braided structure, through various types of narrow openings formed within the butt or end of a racquetball handle. While various racquets have differently sized and shaped openings to accommodate a safety cord, they are all generally small and narrow. In many cases, the narrow opening includes first and second apertures on either side of a pin or rod, used to secure the safety cord, which extends across the narrow opening.

In many cases, people may use scissors, a straightened paper clip, tweezers or pliers to attempt to push the safety cord sufficiently far through a first side of the opening such that they can pull the safety cord through the second side of the opening. Unfortunately, this technique is time consuming, can damage the safety cord, and is often simply ineffective.

SUMMARY

The invention according to exemplary embodiments relates to a method for quickly and easily installing a new wrist strap or safety cord in the butt of a racquet, without damaging the safety cord, as well as to an apparatus that is useful for the method.

Example 1 is a method of installing a safety cord in a racquet having a safety cord pin recessed within a safety cord aperture. An elongate structure of a safety cord installation tool is advanced along a first side of the safety cord pin, and then is advanced along an opposing second side of the safety cord pin. An end of the safety cord is secured to a loop portion of the elongate structure, and the elongate structure is then withdrawn to pull the safety cord around the safety cord pin.

In Example 2, the method of Example 1 in which the safety cord installation tool includes a handle and an elongate structure extending from the handle, the elongate structure including a single wire that is doubled over and secured to the handle.

In Example 3, the method of Example 1 or Example 2 in which withdrawing the safety cord installation tool causes the safety cord to be compressed and thus advance more easily around the safety cord pin.

In Example 4, the method of any of Examples 1-3, further including securing the safety cord to the racquet by knotting the safety cord.

Example 5 is a method of installing a safety cord in a racquetball racquet. A safety cord installation tool is advanced through a first safety cord aperture until a loop portion of the safety cord installation tool extends out of a second safety cord aperture. A safety cord is releasably secured to the loop portion of the safety cord installation tool, and the safety cord installation tool is withdrawn from the first safety cord aperture such that the safety cord is pulled into the second safety cord aperture and out through the first safety cord aperture, thereby securing the safety cord within the racquet.

In Example 6, the method of Example 5 in which the safety cord installation tool includes a handle and an elongate structure extending from the handle, the elongate structure bearing the loop portion.

In Example 7, the method of Example 6 in which the elongate structure includes a single wire that is doubled over and secured to an attachment portion of the handle.

In Example 8, the method of Example 5 in which the elongate structure includes a handle and an elongate structure extending from the handle, the elongate structure coupled to the loop portion.

In Example 9, the method of any of Examples 5-8 in which withdrawing the safety cord installation tool causes the safety cord to be compressed and thus advance more easily through the first and second safety cord apertures.

In Example 10, the method of any of Examples 5-9, further including securing the safety cord to the racquet.

In Example 11, the method of Example 5, further including forming the loop portion from a distal end of the elongate structure subsequent to the advancing step.

Example 12 is a safety cord installation tool that includes a handle and an elongate structure secured to the handle, the elongate structure including a loop that is configured to releasably hold a safety cord.

In Example 13, the safety cord installation tool of Example 12 in which the handle includes a cylindrical rod.

In Example 14, the safety cord installation tool of Example 12 or Example 13 in which the elongate structure includes a single wire that is doubled over, with the loop bent into the doubled over wire.

In Example 15, the safety cord installation tool of any of Examples 12-14 in which the elongate structure is formed from a wire having a diameter of between about 0.005 and 0.025 inches.

In Example 16, the safety cord installation tool of any of Examples 12-15 in which the elongate structure is formed from a guitar string wire having a diameter of about 0.01 inches.

In Example 17, the safety cord installation tool of any of Examples 12-14 in which the elongate structure includes a stranded copper wire.

In Example 18, the safety cord installation tool of any of Examples 12-14 in which the elongate structure includes a stainless steel wire that is about 6 to about 10 inches long.

In Example 19, the safety cord installation tool of any of Examples 12-18 in which the loop is formed by bending a distal most 0.2 to 0.5 inches of the elongate structure.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
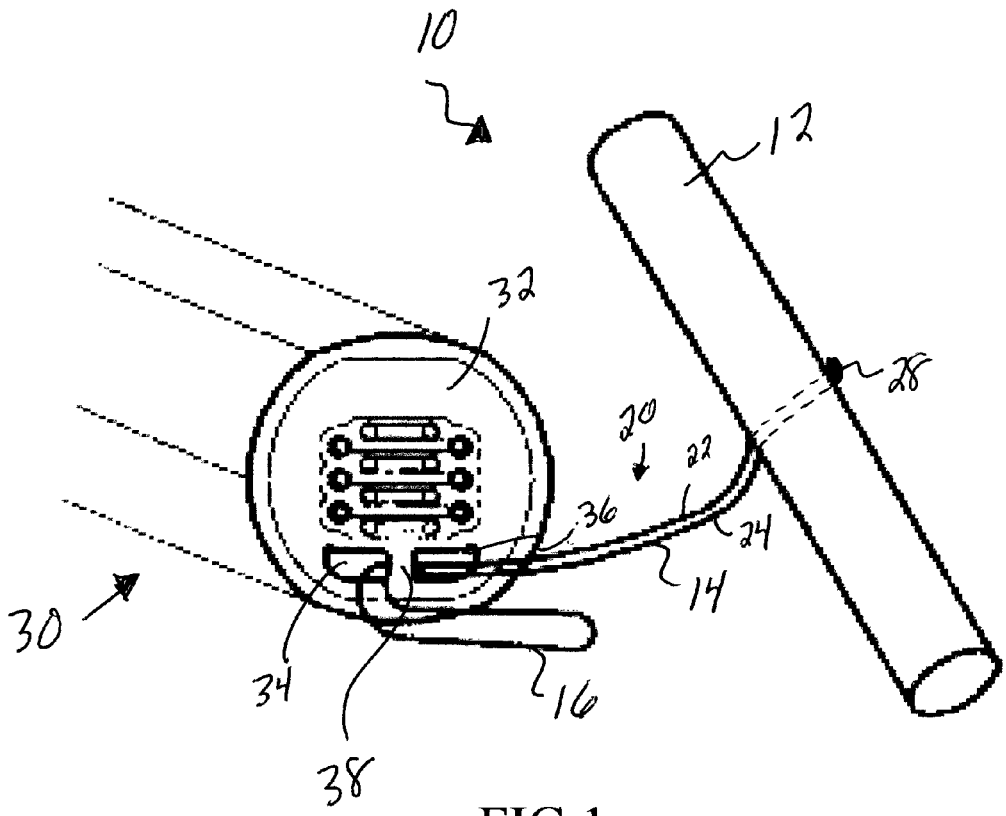
FIG. 1 is a schematic illustration of an initial step in using a safety cord installation tool to install a safety cord in accordance with an embodiment of the invention.

The Figures illustrate a method of installing a safety cord using a safety installation tool 10. As shown in FIG. 1, the safety cord installation tool 10 includes a handle 12 as well as an elongate structure 14 that is configured to be easily advanced through a small opening in the butt of a racquet, be releasably connected to a safety cord, and then pulled back through the opening without damaging the safety cord. In some embodiments, the elongate structure 14 includes a loop portion 16 that is configured to easily and releasably engage the safety cord. In some embodiments, the elongate structure 14 may be configured to permit an end user to bend the elongate structure 14 to form the loop portion 16. In some embodiments, the safety cord installation tool 10 may be used to install any safety cord into a wide variety of racquets, regardless of type or brand of racquet.

The handle 12 is configured to provide the user with a comfortable way to hold onto and use the safety cord installation tool 10. In some embodiments, the handle 12 may be solid or hollow, and may be formed of any suitable material such as wood, plastic or metal. The handle 12 may have a cylindrical shape. In some embodiments, the handle 12 may be a polymeric rod about 0.5 to about 1.0 inches in diameter and about 3 to about 4 inches in length. In some embodiments, the handle 12 may be a polymeric rod have a length of about 3.5 inches and a diameter of about ⅝ inches. The polymeric rod may be colored or colorless and may in some instances include graphics or other decorative features.

In some embodiments, the elongate structure 14 may be formed of a thin, strong wire such as, for example, a steel wire or a copper wire. According to various embodiments, the wire may be a solid wire or it may be a stranded wire. This provides the elongate structure 14 with sufficient flexibility to pass through the safety cord opening in the racquet, while being strong enough to pull the safety cord through without breaking. In some embodiments, as illustrated, the elongate structure 14 may be formed of a single wire 20 that has been doubled over (e.g., bent about 180 degrees near a longitudinal midpoint) to form a first line 22 and a second line 24. In some embodiments, using a single wire 20 in this manner provides the elongate structure 14 with an appropriate balance between strength and flexibility. In other exemplary embodiments, the elongate structure 14 is made from a thin, flexible polymeric material, which is suitable dimensioned for passing through an opening in a racquet handle. In various embodiments, the elongate structure 14 is a distinct structure that is operable coupled to the loop portion 16.

According to exemplary embodiments, both the elongate structure 14 and the loop portion 16 are formed from wire. In various embodiments, the wire has a diameter of between about 0.005 and 0.025 inches. In some embodiments, the wire is a 0.01 or 0.015 inch guitar string, also known as a first string or a second string. In some embodiments, the wire is a single or stranded picture frame wire having a diameter of between about 0.01 inches and about 0.05 inches. In some embodiments, the wire may be a 40 pound mirror hanging wire having a diameter of between about 0.01 and 0.05 inches. In some embodiments, the wire may be a seven strand copper wire of 45 pound test.

In some embodiments, the wire is a single or stranded copper fishing line having a diameter of between about 0.01 inches and about 0.05 inches. In some embodiments, the wire may be a 30 pound test copper fishing line and may have about seven strands. In some embodiments, the wire may be a 45 pound test copper fishing line and may have about seven strands. In some embodiments, the wire may be a large twist tie similar to what is used to seal a garbage bag and may have a diameter of between about 0.005 and 0.025 inches. In some embodiments, the wires may be coated or uncoated.

In some embodiments, the wire is a stainless steel trolling wire having a diameter of about 0.022 inches. In some embodiments, the stainless steel trolling wire may be rated to have a 40 pound test strength. The stainless steel wire may be a single wire. In some embodiments, the stainless steel wire may be a stranded wire.

According to some embodiments, the loop portion 16 is formed at the tip of elongate structure by bending or otherwise forming the distal portion of the wire. The loop portion 16 for example may be formed by bending the last 0.2 to 0.5 inches of the wire at an angle of from about 20 to about 120 degrees with respect to the elongate structure. In one embodiment, the loop portion 16 is formed by bending the distal most 0.25 inches of the wire at an angle of about 90 degrees with respect to the elongate structure 14. In various embodiments, the wire is then formed in a generally circular or oval shape to more readily accept the safety cord 40.

Figure 2:
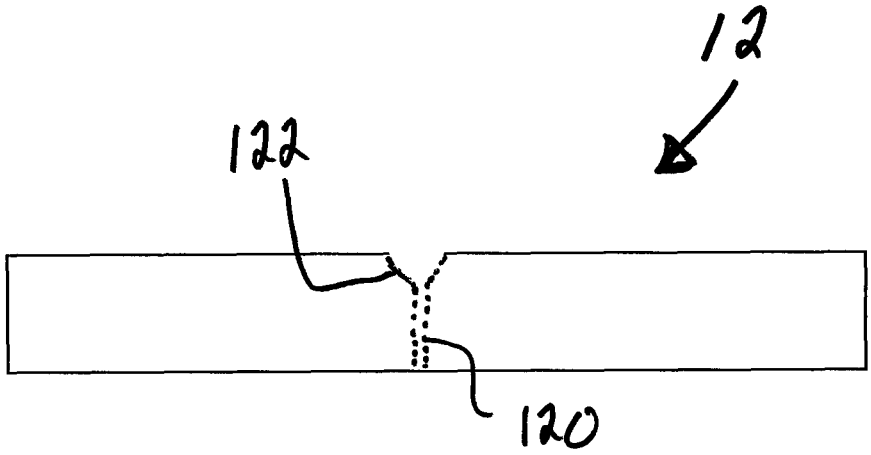
FIG. 2 is a schematic illustration of a portion of the safety cord installation tool of FIG. 1.

In some embodiments, as illustrated in FIG. 2, the handle 12 may include an aperture 120 that extends through the handle 12 to accommodate the elongate structure 14. In some embodiments, the aperture 120 may include a conical section 122 that is sized to accommodate a knot formed in the elongate structure 14 for the purposes of securing the elongate structure 14 to the handle 12. In some embodiments, the conical section 122 may have a top diameter of about ⅛ of an inch and a depth of about ¼ inches. In some embodiments, the aperture 120 may have a diameter of about 1/16 of an inch. These dimensions are merely illustrative, as these dimensions may be varied to accommodate specific dimensions of the elongate structure 14.

The elongate structure 14 is secured to the handle 12. In some embodiments, the first line 22 and the second line 24 may extend through the aperture 120 within the handle 12. The first line 22 and second line 24 may then be tied, soldered, or welded together at point 28 to secure the wire 20 in place and prevent it from being pulled back through the handle 12. In some embodiments, the first line 22 and the second line 24 may be tied to a small ring or other structure that is embedded or otherwise located at point 28 in the handle 12.

As shown in FIG. 1, a racquet includes a racquet butt 30 having an end 32. The end 32 includes a first safety cord aperture 34 and a second safety cord aperture 36. In some embodiments, the first and second safety cord apertures 34 and 36 are disposed on either side of a bar 38. In this description, the relative terms first and second are merely arbitrary. In FIG. 1, the loop portion 16 has been inserted into the second safety cord aperture 36 and extends out through the first safety cord aperture 34. In some embodiments, it is the bar 38 that secures the safety cord 40. In some embodiments, the safety cord 40 may be secured about a pin that is recessed into the racquet butt.

Figure 3:
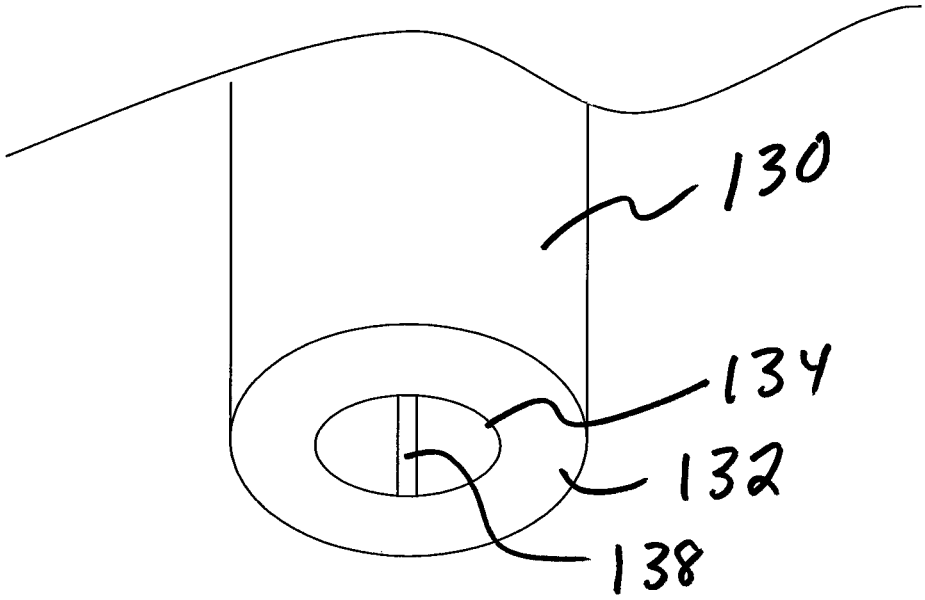
FIG. 3 is a schematic illustration of a portion of a racquet butt in accordance with an embodiment of the invention.

FIG. 3 illustrates a racquet butt 130 having an end 132. The end 132 includes a single aperture 134 that is sized to accommodate the safety cord 40. A pin 138 is disposed within the racquet butt 130 such that the pin 138 spans the aperture 134. In some embodiments, the pin 138 is recessed within the aperture 134. In a racquet having this butt design, the initial step in installing the safety cord 40 includes inserting the loop portion 16 (FIG. 1) into the aperture 134 such that the loop portion 16 loops around the pin 138. In some embodiments, this can be accomplished by bending the loop portion 16 almost flat, inserting the loop portion 16 into the aperture 134 along one side of the pin 138 and then withdrawing the loop portion 16 partially such that a free end of the loop portion 16 comes out on a second side of the pin 138 while the rest of the loop portion 16 remains on the first side of the pin 138.

Figure 4:
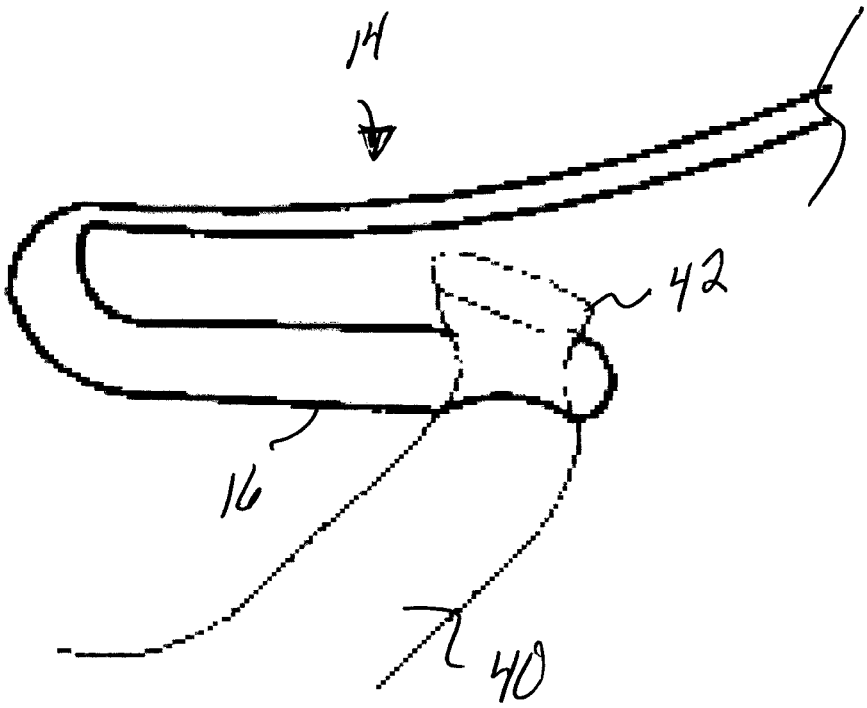
FIG. 4 is a schematic illustration of a second step in using a safety cord installation tool to install a safety cord in accordance with an embodiment of the invention.
Figure 5:
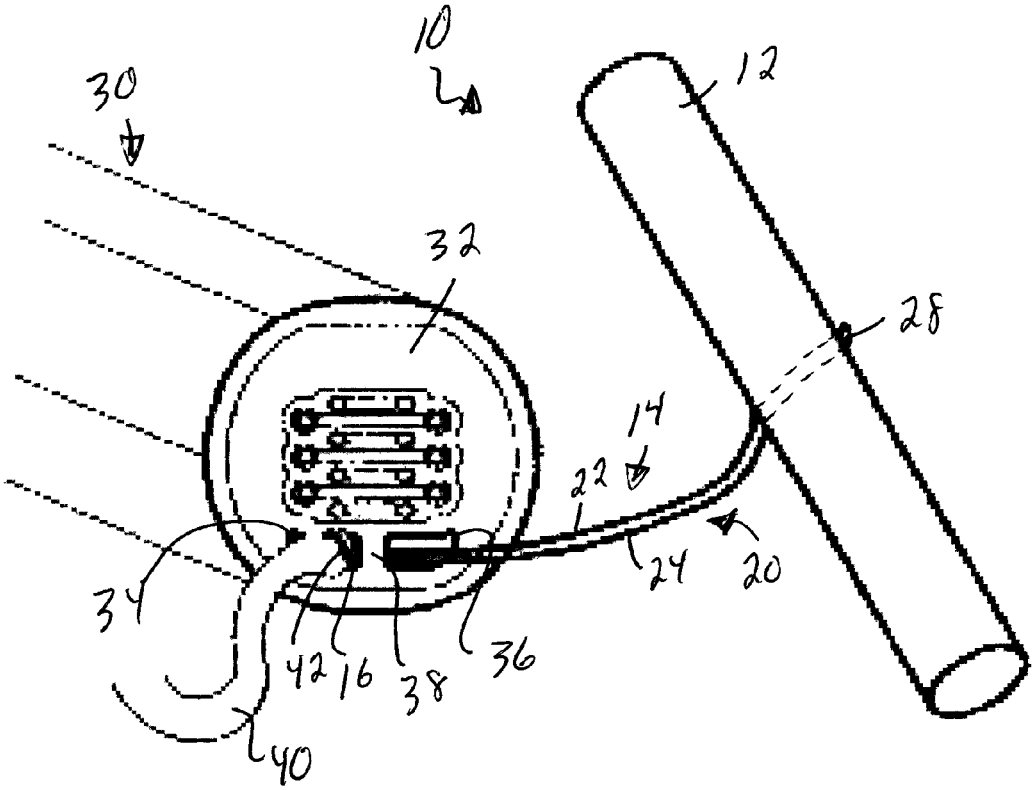
FIG. 5 is a schematic illustration of a third step in using a safety cord installation tool to install a safety cord in accordance with an embodiment of the invention.
Figure 6:
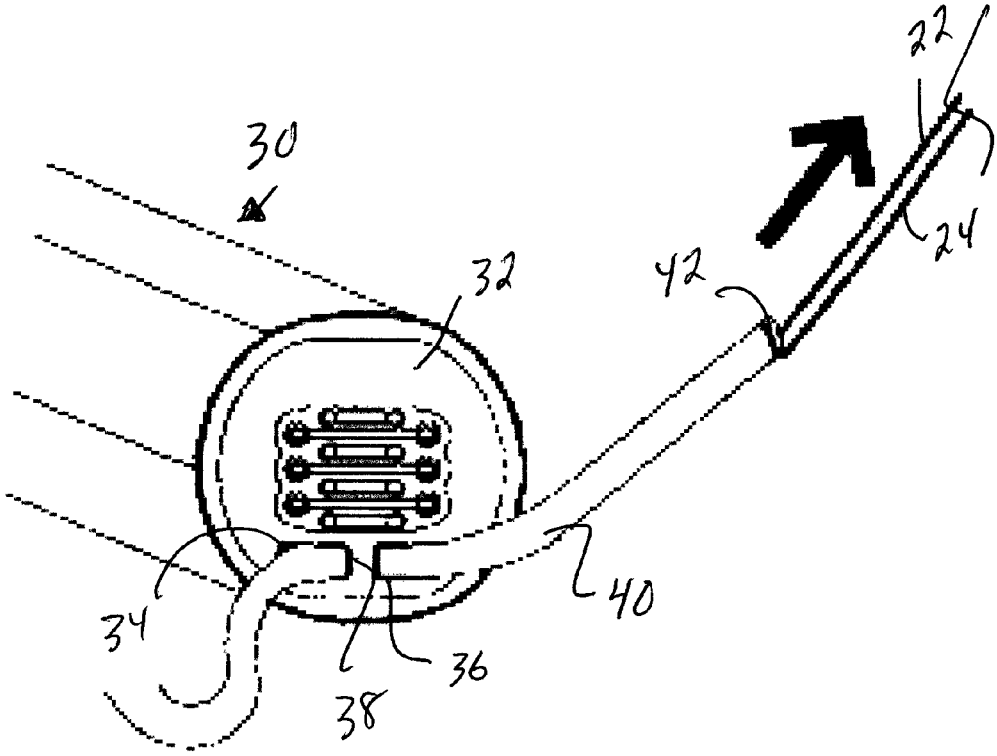
FIG. 6 is a schematic illustration of a fourth step in using a safety cord installation tool to install a safety cord in accordance with an embodiment of the invention.

FIGS. 4 through 6 illustrate subsequent steps in installing the safety cord 40 using the safety cord installation tool 10. As seen in FIG. 4, an end 42 of the safety cord 40 is placed within the loop portion 16 after the loop portion 16 has been advanced through the apertures 34 and 36 (shown in FIG. 1) or through the aperture 134 discussed above with respect to FIG. 3. In some embodiments, the loop portion 16 may be squeezed closed to hold the end 42 of the safety cord 40 in place. In some embodiments, the end 42 of the safety cord 40 is merely advanced through the loop portion 16, such that when the user pulls on the elongate structure 14 it compresses the safety cord 40 and thus engages the cord 40 sufficiently to draw the cord through the opening in the racquet.

In FIG. 5, the safety cord installation tool 10 has been withdrawn to the point at which the end 42 of the safety cord 40 has contacted the first safety cord aperture 34. As shown in FIG. 6 (indicated by the arrow), the user may continue to pull on the safety cord installation tool 10, slowly increasing the force applied to the safety cord installation tool 10, until the safety cord 40 pops through. In some embodiments, pulling on the safety cord 40 via the loop 16 compresses the safety cord 40 such that it passes more easily through the first and second safety cord apertures 34 and 36. After the end 42 of the safety cord 40 is pulled through the opening and extends around the bar 38 or the pin 138, the installation tool 10 is removed and the cord is tied or otherwise secured to the racquet butt.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

We claim:

1. A method of installing a safety cord in a racquet having a safety cord pin recessed within a safety cord aperture, the method comprising steps of:

advancing an elongate structure of a safety cord installation tool into the safety cord aperture, along a first side of the safety cord pin and around at least a portion of the safety cord pin, until a distal portion of the elongate structure extends out of the safety cord aperture on a second side of the safety cord pin;

advancing an end portion of the safety cord through a loop portion of the elongate structure;

withdrawing the elongate structure from the safety cord aperture so as to pull the safety cord through the safety cord aperture and around the safety cord pin, such that the safety cord extends into the safety cord aperture on the first side of the safety cord pin and extends out of the safety cord aperture on the second side of the safety cord pin; and removing the safety cord from the loop portion of the elongate structure.

2. The method of claim 1, wherein the safety cord installation tool comprises a handle and an elongate structure extending from the handle, the elongate structure including a single wire that is doubled over and secured to the handle.

3. The method of claim 1, wherein withdrawing the safety cord installation tool causes the safety cord to be compressed and thus advance more easily around the safety cord pin.

4. The method of claim 1, further comprising a step of knotting the safety cord to secure the safety cord to the racquet.

5. A method of installing a safety cord in a racquet, the method comprising steps of:

advancing an elongate structure of a safety cord installation tool through a first safety cord aperture disposed on a first side of a safety cord retaining bar and at least partially around the safety cord retaining bar until a loop portion of the safety cord installation tool extends out of a second safety cord aperture disposed on a second side of the safety cord retaining bar;

extending an end portion of the safety cord through the loop portion of the safety cord installation tool;

withdrawing drawing the elongate structure through the first and second safety cord apertures such that the safety cord extends through the first safety cord aperture, at least partially around the safety cord retaining bar, and through the second safety cord aperture; and removing the safety cord from the loop portion of the safety cord installation tool.

6. The method of claim 5, wherein the safety cord installation tool comprises a handle and an elongate structure extending from the handle, the elongate structure including the loop portion.

7. The method of claim 6, wherein the elongate structure comprises a single wire that is doubled over and secured to an attachment portion of the handle.

8. The method of claim 5, wherein the safety cord installation tool comprises a handle and an elongate structure extending from the handle, the elongate structure coupled to the loop portion.

9. The method of claim 5, wherein withdrawing the safety cord installation tool causes the safety cord to be compressed and thus advance more easily through the first and second safety cord apertures.

10. The method of claim 5, further comprising securing the safety cord to the racquet.

11. The method of claim 5, further comprising, after the advancing step, forming the loop portion from the distal end of the elongate structure.

* * * * *